US010833444B2

(12) United States Patent
Maesoba et al.

(10) Patent No.: US 10,833,444 B2
(45) Date of Patent: Nov. 10, 2020

(54) TERMINAL UNIT AND CONNECTOR

(71) Applicants: AutoNetworks Technologies, Ltd., Mie (JP); Sumitomo Wiring Systems, Ltd., Mie (JP); SUMITOMO ELECTRIC INDUSTRIES, LTD., Osaka (JP)

(72) Inventors: Hiroyoshi Maesoba, Mie (JP); Toshifumi Ichio, Mie (JP)

(73) Assignees: AutoNetworks Technologies, Ltd. (JP); Sumitomo Wiring Systems, Ltd. (JP); Sumitomo Electric Industries, Ltd. (JP)

( * ) Notice: Subject to any disclaimer, the term of this patent is extended or adjusted under 35 U.S.C. 154(b) by 0 days.

(21) Appl. No.: 16/492,974

(22) PCT Filed: Feb. 21, 2018

(86) PCT No.: PCT/JP2018/006265
§ 371 (c)(1),
(2) Date: Sep. 11, 2019

(87) PCT Pub. No.: WO2018/168367
PCT Pub. Date: Sep. 20, 2018

(65) Prior Publication Data

US 2020/0083633 A1 Mar. 12, 2020

(30) Foreign Application Priority Data

Mar. 13, 2017 (JP) ..... 2017-046959

(51) Int. Cl.
*H01R 13/436* (2006.01)
*H01R 4/18* (2006.01)
(Continued)

(52) U.S. Cl.
CPC ..... *H01R 13/4365* (2013.01); *H01R 4/185* (2013.01); *H01R 13/113* (2013.01);
(Continued)

(58) Field of Classification Search
CPC ..... H01R 13/4365
See application file for complete search history.

(56) References Cited

U.S. PATENT DOCUMENTS 5,518,428 A * 5/1996 Onoda ..... H01R 13/4223 439/595
7,559,808 B2 * 7/2009 Nishide ..... H01R 13/4362 439/595
(Continued)

FOREIGN PATENT DOCUMENTS

DE 12018001279 T5 11/2019
JP 7-176342 7/1995
(Continued)

OTHER PUBLICATIONS

International Search Report dated Apr. 24, 2018.

*Primary Examiner* — Ross N Gushi
(74) *Attorney, Agent, or Firm* — Gerald E. Hespos; Michael J. Porco; Matthew T. Hespos

(57) ABSTRACT

A terminal unit (30) has inner conductors in a dielectric (36) and is mounted in a first or second housing (10, 20). The first housing (10) includes a first locking lance (14), a front retainer (17) and a first accommodation chamber (13). The second housing (20) includes a second locking lance (22), a second accommodation chamber (21) and a side retainer (25). First and second locks (45, 54) are formed on a surface of the dielectric (36). The terminal unit (30) inserted into the first accommodation chamber (13) is retained by the front retainer (17) restricting deflection of the first locking lance (14) and the first lock (45) locking the first locking lance (14). The terminal unit (30) inserted into the second accommodation chamber (21) is retained by locking the first lock (45) with the second locking lance (22) and locking the second lock (54) with the side retainer (25).

4 Claims, 12 Drawing Sheets

(51) Int. Cl.
*H01R 13/11* (2006.01)
*H01R 13/502* (2006.01)
*H01R 43/20* (2006.01)

(52) U.S. Cl.
CPC ..... *H01R 13/4361* (2013.01); *H01R 13/502* (2013.01); *H01R 43/20* (2013.01)

(56) References Cited

U.S. PATENT DOCUMENTS 7,993,170 B2 * 8/2011 Nakata ..... H01R 13/4223 439/877
8,118,609 B2 * 2/2012 Sasaki ..... H01R 13/506 439/188
8,133,076 B2 * 3/2012 Nakamura ..... H01R 13/516 439/595
8,235,752 B2 * 8/2012 Nakamura ..... H01R 13/5205 439/587
8,454,378 B2 * 6/2013 Osterhart ..... H01R 24/84 439/284
8,747,156 B2 * 6/2014 Hirabayashi ..... H01R 13/4223 439/595
8,747,168 B2 * 6/2014 Kida ..... H01R 13/641 439/701
8,876,543 B2 * 11/2014 Oka ..... H01R 13/6272 439/353
9,142,904 B2 * 9/2015 Martin ..... H01R 13/424
9,543,707 B2 * 1/2017 Miyoshi ..... H01R 13/502
9,799,983 B2 * 10/2017 Lane ..... H01R 24/40
9,997,858 B2 * 6/2018 Mogi ..... H01R 9/223
10,283,891 B2 * 5/2019 Maesoba ..... H01R 9/037
10,297,932 B2 * 5/2019 Maesoba ..... H01R 24/60
10,305,202 B2 * 5/2019 Maesoba ..... H01R 13/6581
10,367,290 B2 * 7/2019 Maesoba ..... H01R 13/4365
10,424,862 B2 * 9/2019 Oishi ..... H01R 13/4223
10,439,331 B2 * 10/2019 Maesoba ..... H01R 13/6581
10,490,928 B2 * 11/2019 Matsui ..... H01R 13/516
10,511,116 B2 * 12/2019 Maesoba ..... H01R 13/658
10,566,725 B2 * 2/2020 Ochiai ..... H01R 13/4226
10,581,195 B2 * 3/2020 Linseder ..... H01R 43/20
2008/0233796 A1 * 9/2008 Segrt ..... H01R 13/5205 439/578
2015/0155670 A1 6/2015 Gardner
2018/0254579 A1 9/2018 Miyamura
2018/0261945 A1 9/2018 Maesoba
2019/0006792 A1 1/2019 Yamanaka
2019/0140391 A1 * 5/2019 Oishi ..... H01R 13/64
2019/0199008 A1 * 6/2019 Kanemura ..... H01R 13/4362
2019/0199028 A1 * 6/2019 Maesoba ..... H01R 13/113
2019/0214763 A1 * 7/2019 Hung ..... H01R 12/52
2019/0252806 A1 * 8/2019 Maesoba ..... H01R 9/035
2019/0288456 A1 * 9/2019 Maesoba ..... H01R 13/187
2019/0296491 A1 * 9/2019 Maesoba ..... H01R 13/6474
2019/0312388 A1 * 10/2019 Maesoba ..... H01R 24/60
2019/0319406 A1 * 10/2019 Maesoba ..... H01R 13/6463
2020/0021054 A1 * 1/2020 Maesoba ..... H01R 13/113
2020/0036129 A1 * 1/2020 Maesoba ..... H01R 13/4364
2020/0059033 A1 * 2/2020 Matsui ..... H01R 13/6592
2020/0083633 A1 * 3/2020 Maesoba ..... H01R 43/20

FOREIGN PATENT DOCUMENTS

JP 10-162888 6/1998
JP 10-321280 12/1998
JP 2002-319456 10/2002
JP 2012-129103 7/2012
JP 2014-120484 6/2014
JP 2015-537327 12/2015

* cited by examiner

TERMINAL UNIT AND CONNECTOR

BACKGROUND

Field of the Invention

The invention relates to a terminal unit and a connector.

Related Art

Japanese Unexamined Patent Publication No. 2012-129103 discloses a connector with a terminal unit accommodating an inner conductor terminal in a dielectric and a housing for accommodating the terminal unit. A resiliently deflectable locking lance is formed in the housing to a locking projection formed on an outer surface of the dielectric for retaining and holding the terminal unit inserted into the housing.

However, there is concern that resiliently deflectable locking lance may be disengaged from the locking projection due to an impact, vibration or the like. Thus, it is desired to improve the reliability of a function for retaining the terminal unit.

The invention was completed on the basis of the above situation and aims to improve the reliability of a function for retaining a terminal unit.

SUMMARY

A first aspect of the invention is directed to a terminal unit accommodating an inner conductor in a dielectric. The terminal unit is mountable into a selected one of a first housing and a second housing. The first housing includes a resiliently deflectable first locking lance, a front retainer capable of restricting resilient deflection of the first locking lance and a first accommodation chamber. The second housing includes a resiliently deflectable second locking lance, a second accommodation chamber and a side retainer facing the second accommodation chamber. A first locking portion and a second locking portion are formed on an outer surface of the dielectric. The terminal unit is retained by the front retainer restricting the resilient deflection of the first locking lance and the first locking portion being locked to the first locking lance when the terminal unit is inserted in the first accommodation chamber. On the other hand, the terminal unit is retained by locking of the first locking portion and the second locking lance and locking of the second locking portion and the side retainer with the terminal unit inserted in the second accommodation chamber.

A second aspect of the invention is directed to a connector configured by inserting a terminal unit into a selected one of a first accommodation chamber formed in a first housing and a second accommodation chamber formed in a second housing. The terminal unit accommodates an inner conductor in a dielectric. A resiliently deflectable first locking lance is formed in the first accommodation chamber, and the connector further includes a front retainer configured to restrict resilient deflection of the first locking lance by being mounted into the first housing. A resiliently deflectable second locking lance is formed in the second accommodation chamber, and the connector further includes a side retainer mounted into the second housing to face inside of the second accommodation chamber. A first locking portion is formed on an outer surface of the dielectric and is configured to retain the terminal unit by being locked to the first locking lance when the terminal unit is inserted into the first accommodation chamber and to retain the terminal unit by being locked to the second locking lance when the terminal unit is inserted into the second accommodation chamber. A second locking portion is formed on the outer surface of the dielectric and is configured to retain the terminal unit by being locked to the side retainer when the terminal unit is inserted into the second accommodation chamber.

When the terminal unit is inserted into the first accommodation chamber, the first locking portion is locked to the first locking lance and the front retainer is mounted into the first housing to restrict the resilient deflection of the locking lance so that the terminal unit can be retained reliably. When the terminal unit is inserted into the second accommodation chamber, the first locking portion is locked to the second locking lance and the side retainer is locked to the second locking portion so that the terminal unit can be retained reliably. The terminal unit can be used as a common member for the first housing and the second housing of different types.

The first and second locking portions may be disposed in regions of the outer surface of the dielectric on opposite sides in a direction intersecting an inserting direction into the first and second accommodation chambers. According to this configuration, the first and second locking portions are disposed in different regions. Thus, there is a high degree of freedom in design with respect to the shapes and the arrangements of the first and second locking portions.

A front stop may be formed in the region of the outer surface of the dielectric where the second locking portion is disposed and may be configured to restrict a movement of the terminal unit inserted into the first or second accommodation chambers beyond a proper insertion position. According to this configuration, the first locking lance and the second locking lance do not resiliently come into contact with the region where the second locking portion is formed. Thus, the front stop does not create insertion resistance due to resilient interference with the first or second locking lance.

The second locking portion and the front stop may be formed integrally to a single projection. According to this configuration, the strengths of the second locking portion and the front stop can be enhanced as compared to the case where the second locking portion and the front stop project separately.

DETAILED DESCRIPTION

An embodiment of the invention is described with reference to FIGS. 1 to 13. Note that, in the following description, a left side in FIGS. 1 to 4 and 6 to 13 is defined as a front side concerning a front-rear direction. Upper and lower sides shown in FIGS. 1 to 8 and 10 to 13 are directly defined as upper and lower sides concerning a vertical direction.

A terminal unit 30 of this embodiment constitutes a first connector A (connector as claimed) of a waterproof type by being mounted into a first housing 10 and constitutes a second connector B (connector as claimed) of a non-waterproof type by being mounted into a second housing 20.

Figure 7:
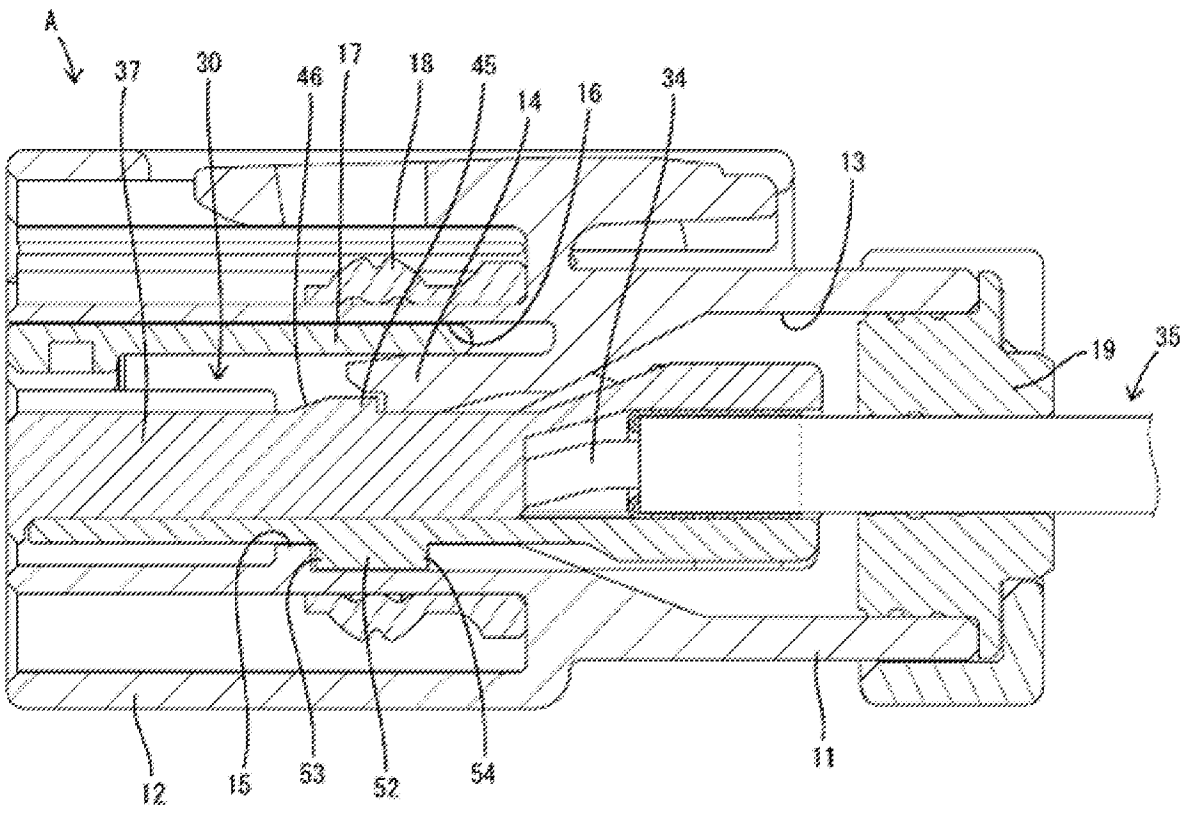
FIG. 7 is a side view in section showing a state where a front retainer is at a full locking position in a first connector.
Figure 8:
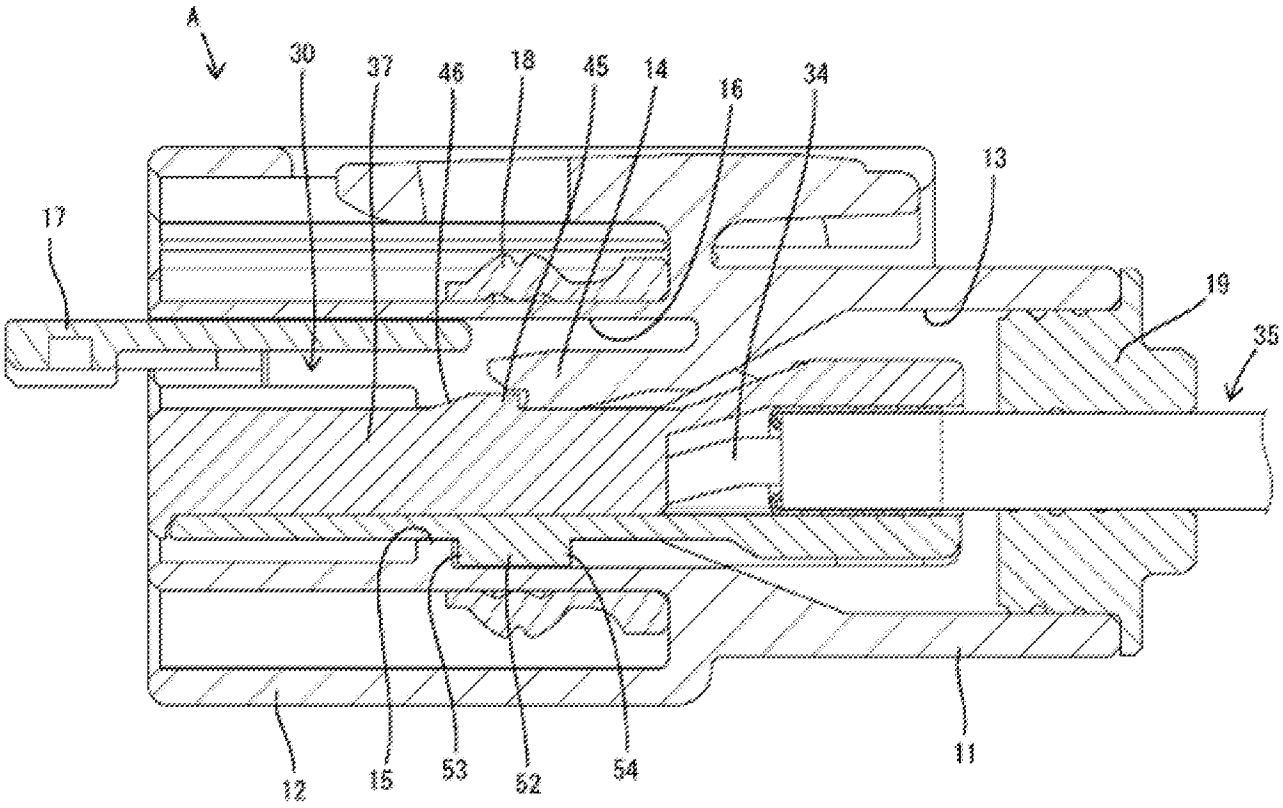
FIG. 8 is a side view in section showing a state where the front retainer is at a partial locking position in the first connector.
Figure 9:
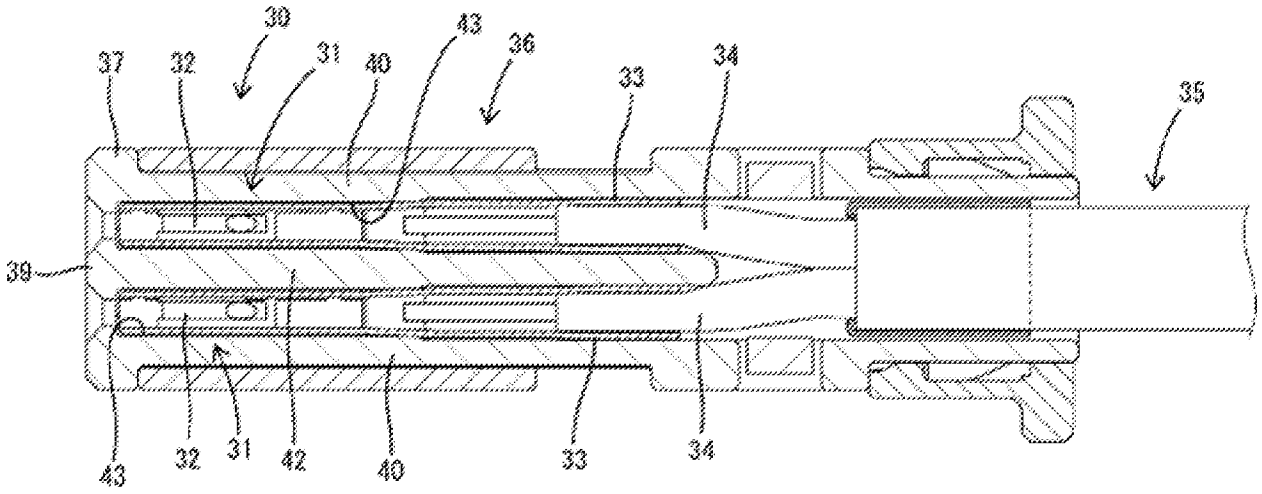
FIG. 9 is a bottom view showing a state where inner conductors are mounted in a first component.
Figure 10:
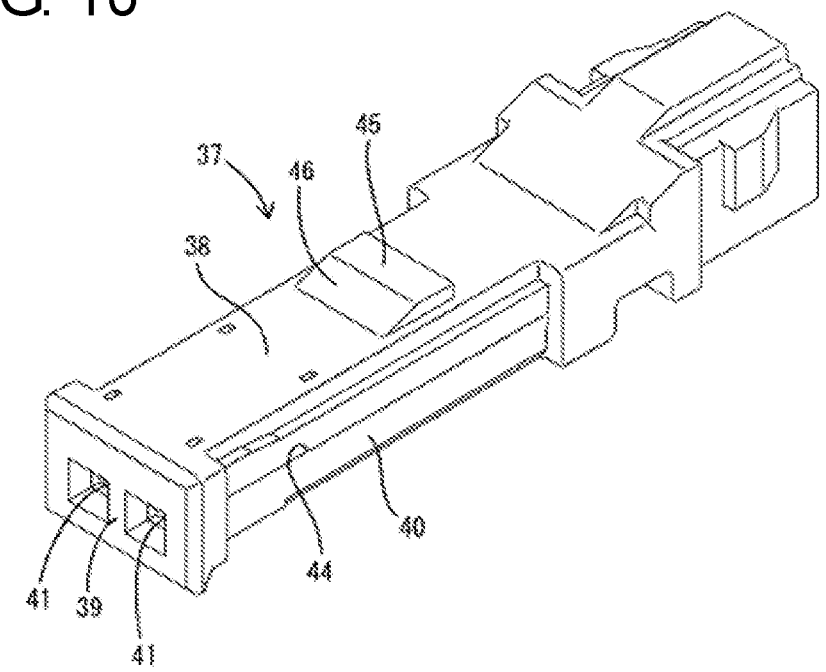
FIG. 10 is a perspective view of the first component.
Figure 11:
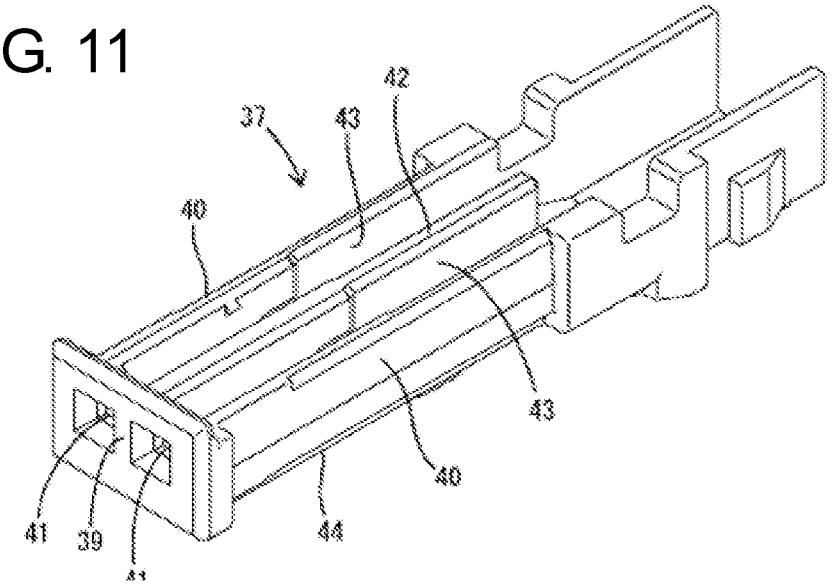
FIG. 11 is a perspective view of the first component in a vertically inverted state.
Figure 12:
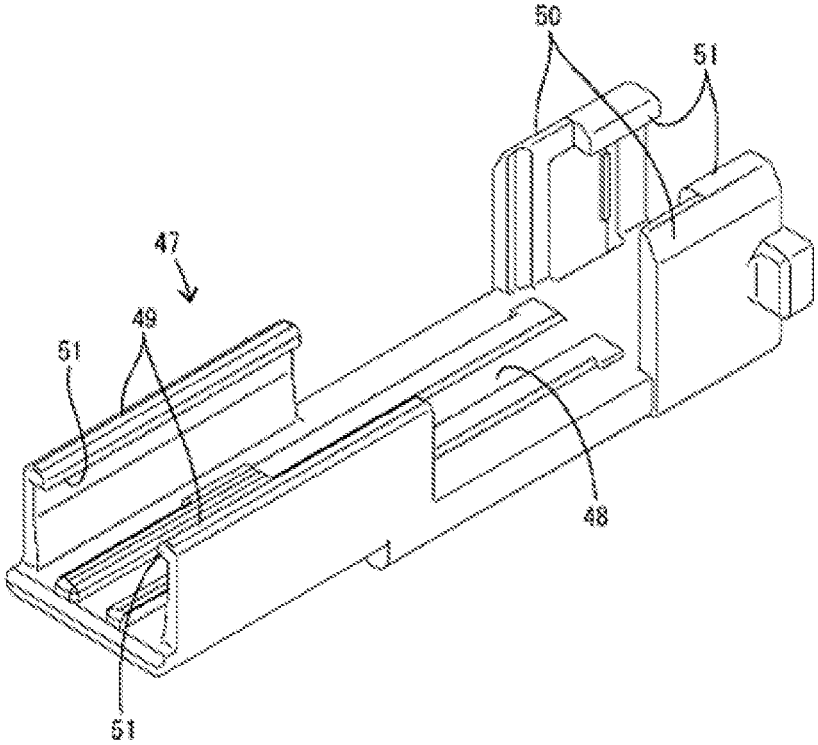
FIG. 12 is a perspective view of a second component.
Figure 13:
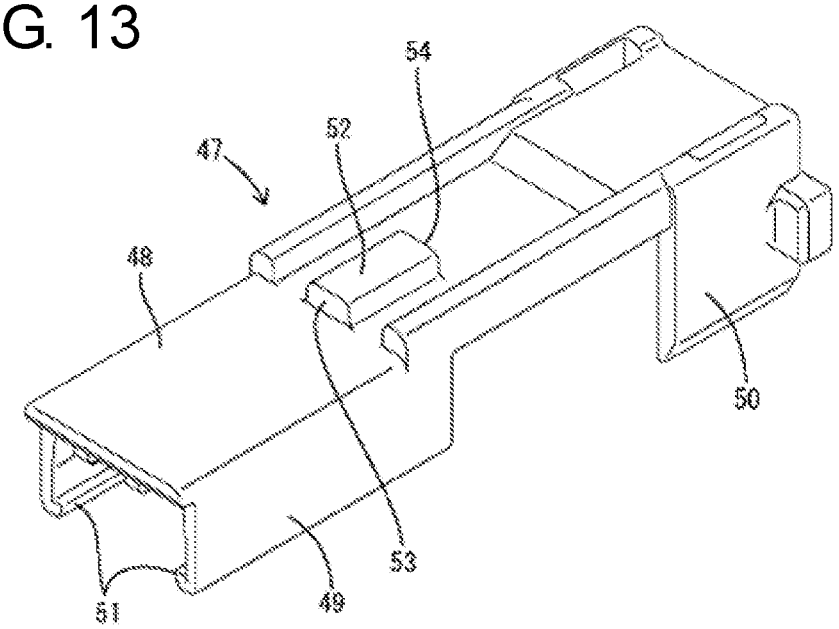
FIG. 13 is a perspective view of the second component in a vertically inverted state.

The first housing 10 is made of synthetic resin and, as shown in FIGS. 7 and 8, is a single component including an accommodating portion 11 and a tubular fitting portion 12 extending forward from the outer periphery of the accommodating portion 11 and surrounding the accommodating portion 11 over the entire periphery. A first accommodation chamber 13 is formed inside the accommodating portion 11. The terminal unit 30 is inserted into the accommodation chamber 13 from behind the first housing 10. A first locking lance 14 IS cantilevered forward from an inner upper surface of the first accommodation chamber 13 and is resiliently deflectable upward. A step-like first stopper 15 is formed on an inner lower surface of the first accommodation chamber 13.

Figure 6:
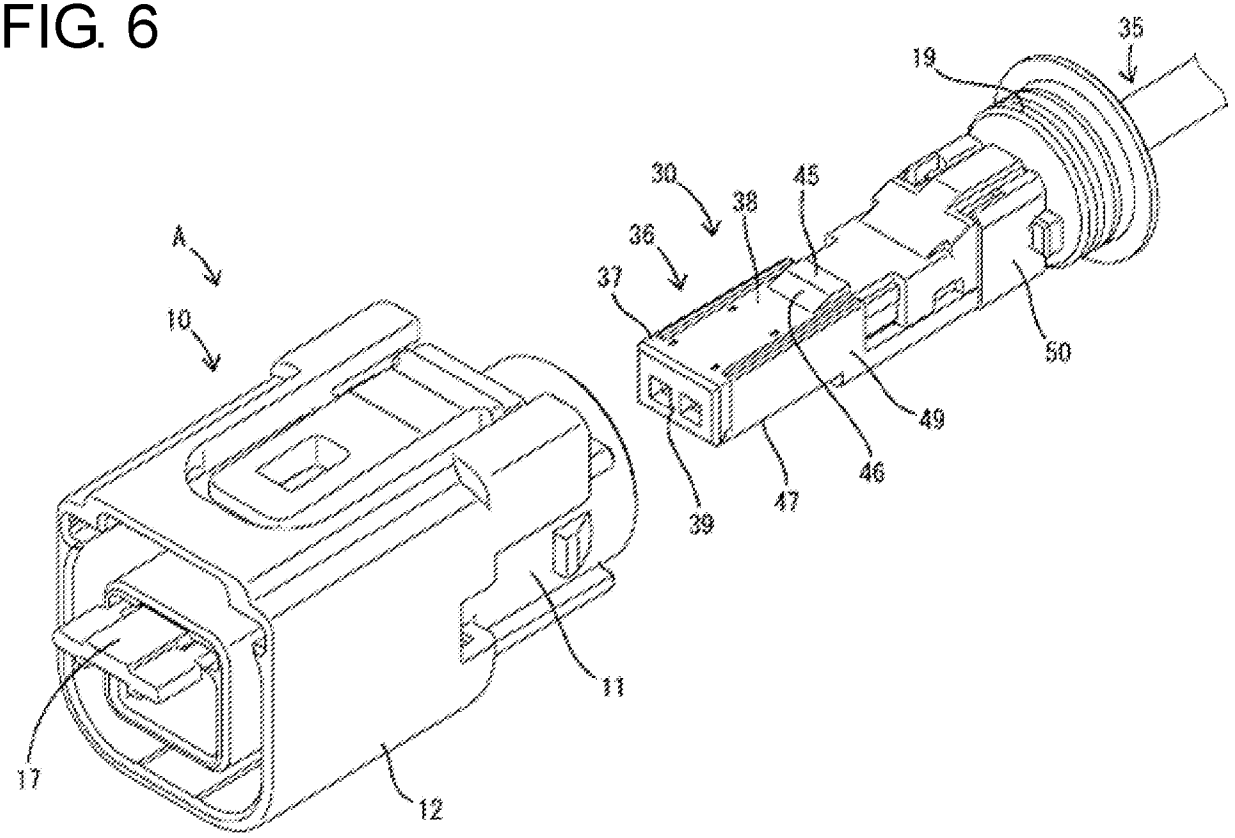
FIG. 6 is a perspective view showing a state where a first housing and the terminal unit are separated.

The accommodating portion 11 is formed with a deflection space 16 for allowing the first locking lance 14 to be deflected resiliently upward. A front retainer 17 is mounted into the accommodating portion 11 from the front of the first housing 10. The front retainer 17 mounted in the accommodating portion 11 is movable in the front-rear direction between a partial locking position where the front retainer 17 is forward of the deflection space 16 to allow the resilient deflection of the first locking lance 14, as shown in FIGS. 6 and 8, and a full locking position where the front retainer 17 enters the deflection space 16 to restrict the resilient deflection of the first locking lance 14, as shown in FIG. 7.

The deflection space 16 is not open in the outer peripheral surface of the accommodating portion 11 and is open in the front surface of the accommodating portion 11. Further, a seal ring 18 is mounted on a rear end part of the outer periphery of the accommodating portion 11. When a receptacle-like mating housing (not shown) is fit between the outer periphery of the accommodating portion 11 and the inner periphery of the tubular fitting portion 12, a gap between the accommodating portion 11 and the mating housing is waterproofed by the seal ring 18.

Figure 1:
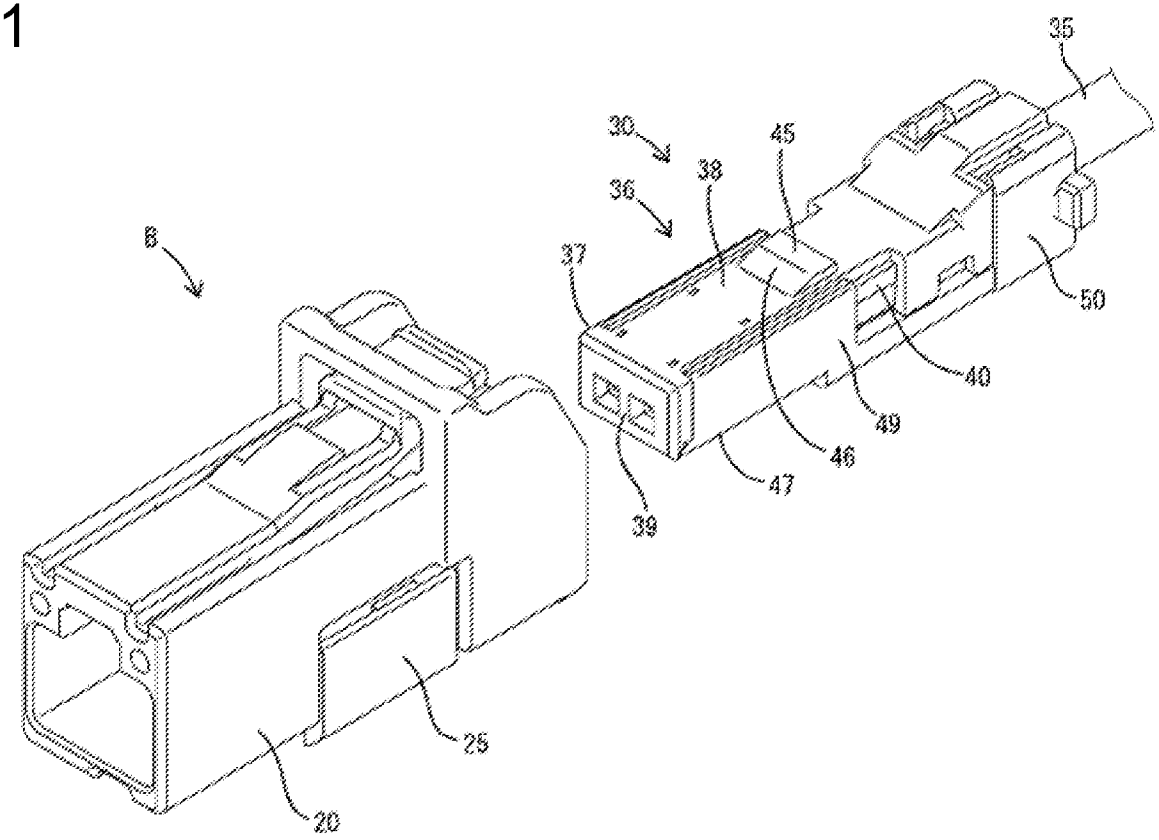
FIG. 1 is a perspective view showing a state where a second housing and a terminal unit are separated in one embodiment when viewed obliquely from above.
Figure 2:
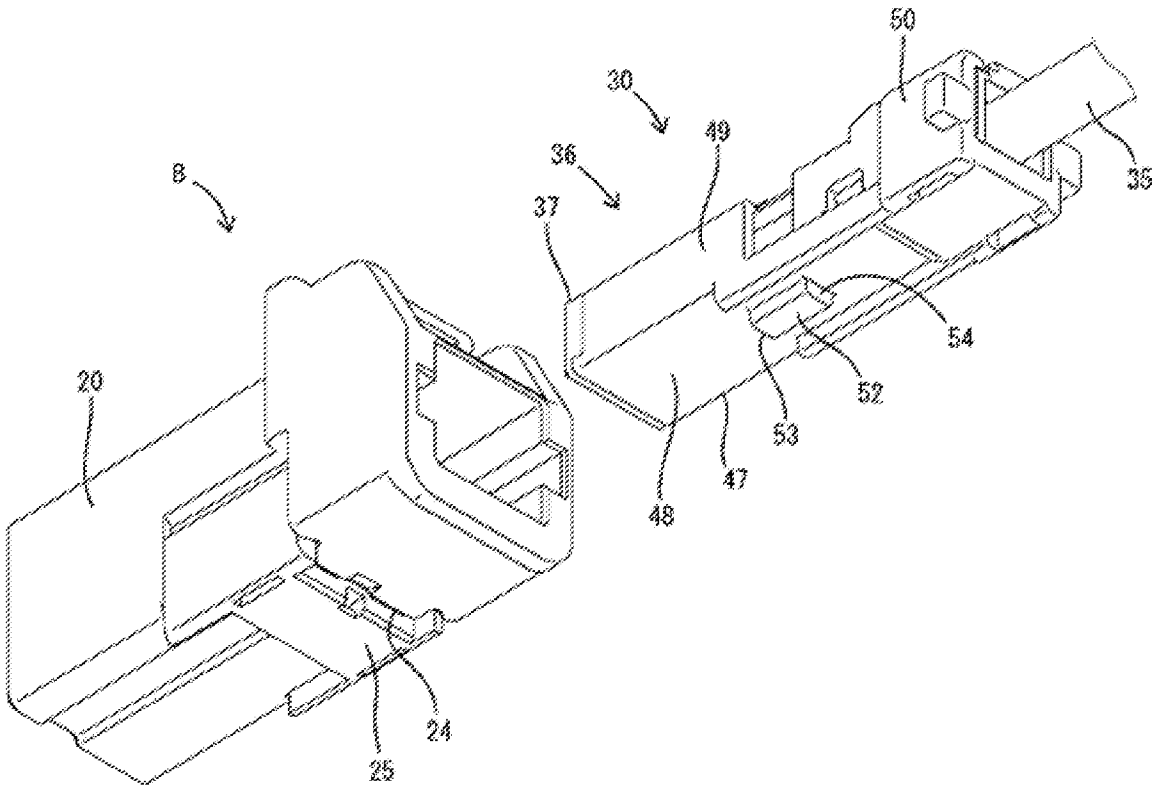
FIG. 2 is a perspective view showing the state where the second housing and the terminal unit are separated when viewed obliquely from below.
Figure 3:
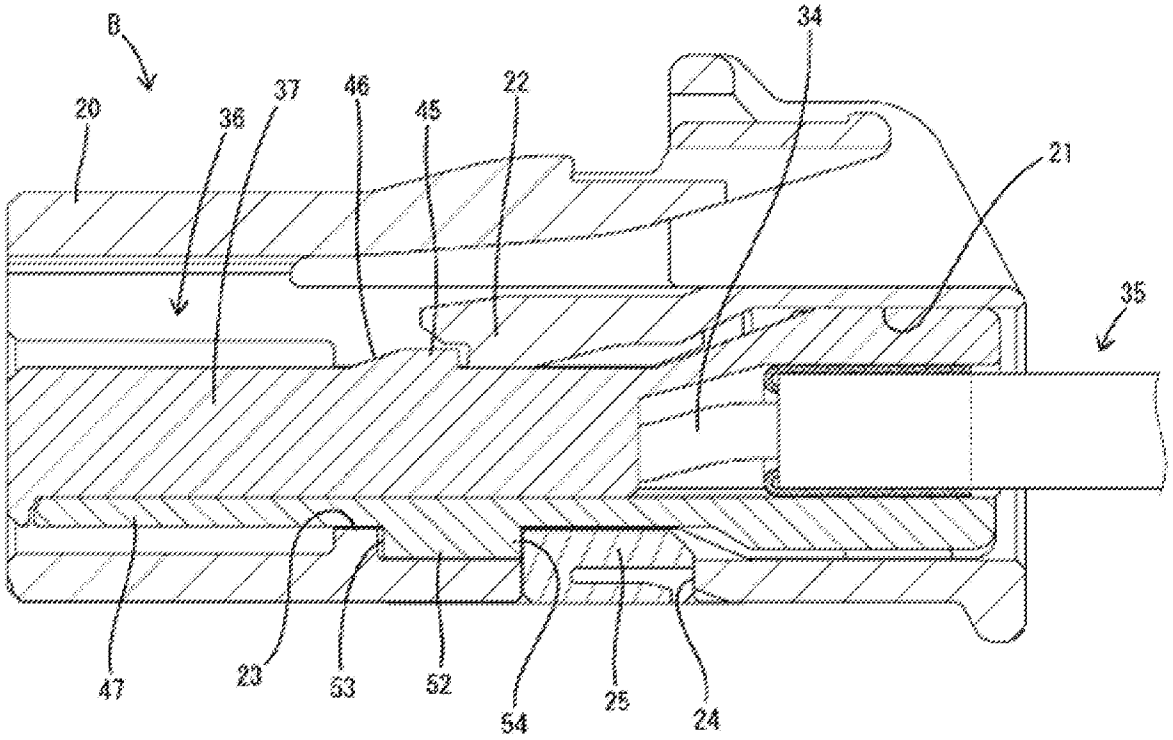
FIG. 3 is a side view in section showing a state where a side retainer is at a full locking position in a second connector.
Figure 4:
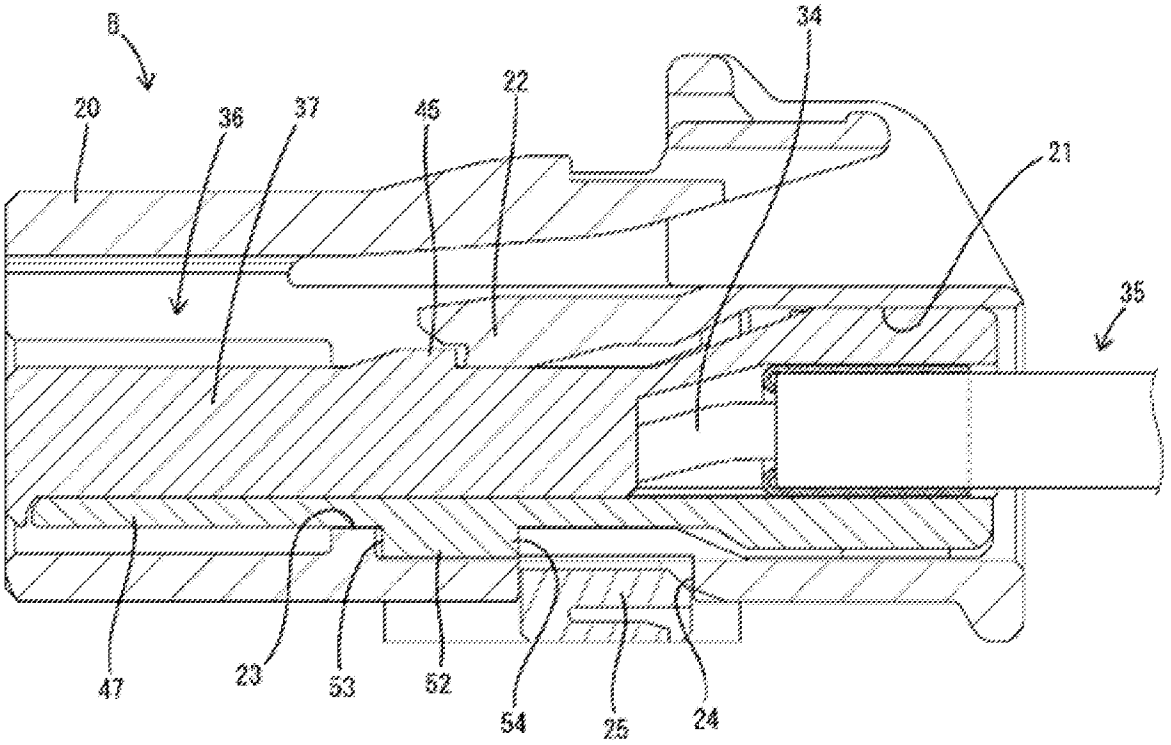
FIG. 4 is a side view in section showing a state where the side retainer is at a partial locking position in the second connector.
Figure 5:
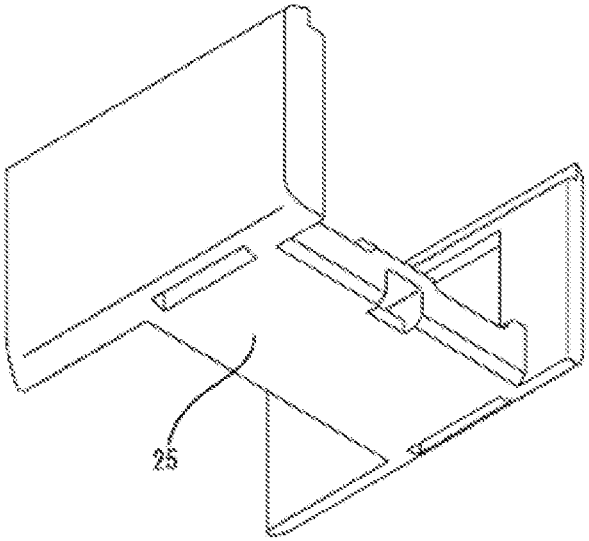
FIG. 5 is a perspective view of the side retainer.

The second housing 20 is made of synthetic resin. As shown in FIGS. 3 and 4, a second accommodation chamber 21 is formed inside the second housing 20. The terminal unit 30 is inserted into the second accommodation chamber 21 from behind the second housing 20. A second locking lance 22 is cantilevered forward from an inner upper surface of the second accommodation chamber 21 and is resiliently deflectable upward. A step-like second stopper 23 is formed on an inner lower surface of the second accommodation chamber 21.

A mounting hole 24 is formed through the lower surface of the second housing 20 and communicates with the inside of the second accommodation chamber 21. A side retainer 25 is mounted into the mounting hole 24. The side retainer 25 mounted in the mounting hole 24 is movable vertically (direction intersecting an inserting/withdrawing direction of the terminal unit 30 into and from the second accommodation chamber 21) between a partial locking position where the side retainer 25 is retracted to the outside of the second accommodation chamber 21, as shown in FIG. 4, and a full locking position where the side retainer 25 is located in the accommodation chamber 21, as shown in FIG. 3.

The terminal unit 30 is a connecting member constituting a wiring harness for Ethernet (registered trademark) high-speed communication circuit of an automotive vehicle, and is configured by accommodating two inner conductors 31 into a dielectric 36. The inner conductor 31 is long in the front-rear direction, and a rectangular tubular body is formed in a front end part of the inner conductor 31. A tab-like mating conductor (not shown) is inserted into the body 32 from the front of the inner conductor 31, and the mating conductor and the inner conductor 31 are connected conductively. A crimping portion 33 in the form of an open barrel is formed in a rear end part of the inner conductor 31, and a front end part of a wire 34 is fixed conductively to the crimping portion 33. Two of the wires 34 connected to two inner conductors 31 constitute a twisted pair cable 35.

The dielectric 36 is configured by vertically uniting a first component 37 made of synthetic resin and having a halved shape and a second component 47 made of synthetic resin and having a halved shape (along a direction intersecting axes of the front end parts of the wires 34). The first and second components 37, 47 are made of polybutylene terephthalate (PBT).

The first component 37 includes an upper wall 38 elongated in the front-rear direction, a front wall 39 extending down from the front end edge of the upper wall 38 and left and right side walls 40 extending down from both left and right sides of the upper wall 38. Left and right insertion openings 41 penetrate through the front wall portion 39 and mating conductors are inserted therethrough. The first component 37 is formed with a separation wall 42 extending down from a central part of the upper wall 38 in the front-rear direction, and regions between the side walls 40 and the separation wall 42 serve as left and right grooves 43 elongated in the front-rear direction. Left and right step-like locks 44 are formed on outer side surfaces of the left and right separation walls 42.

A projection-like first locking portion 45 is formed integrally on the upper surface (outer surface) of the upper wall 38. The first locking portion 45 is disposed in a substantially central part of the upper wall 38 in the front-rear direction and in a center of the upper wall 38 in a lateral direction. A front part of the first locking portion 45 is formed with an inclined surface 46 inclined with respect to the front-rear direction (inserting direction of the terminal unit 30 into the housing). A rear end surface of the first locking portion 45 serves as a locking surface substantially at a right angle to the front-rear direction.

The second component 47 includes a bottom wall 48 elongated in the front-rear direction, left and right front outer walls 49 extending up from both left and right sides of a front end part of the bottom wall 48 and left and right rear outer walls 50 extending up from both left and right sides of a rear end part of the bottom wall 48. Lock projections 51 are formed on the inner surfaces of extending end parts of these outer walls 49, 50.

A rib-like projection 52 extending in the front-rear direction is formed on the lower surface (outer surface) of the bottom wall 48. The projection 52 is disposed substantially at a center position of the bottom wall 48 in the front-rear direction and at a center position of the bottom wall 48 in the lateral direction. A front part of the projection 52 serves as a front stop 53 having a front stop surface substantially at a right angle to the front-rear direction. A rear end part of the projection 52 serves as a second locking portion 54 having a locking surface substantially at a right angle to the front-rear direction.

In assembling the first component 37 and the second component 47, the two inner conductors 31 are accommodated into the left and right grooves 43 of the first component 37. Since the first component 37 and the second component 47 are divided and united in the vertical direction intersecting substantially at a right angle to the front end parts of the wires 34, a moving direction of the inner conductors 31 when the inner conductors 31 are mounted into the first component 37 also is a direction intersecting substantially at a right angle to the axes of the front end parts of the wires 34. In this way, an untwisted length of the wires 34 can be suppressed as short as possible in the front parts of the two wires 34 constituting the twisted pair cable 35 so a reduction of a noise reducing function caused by the untwisting of the wires 34 can be avoided.

After the two inner conductors 31 are mounted into the first component 37, the second component 47 is assembled from below to be united with the first component 37. The united first and second components 37 and 47 are held united by the locking of the lock projections 51 and the lock portions 44. An assembling direction of the second component 47 with the first component 37 is a direction intersecting substantially at a right angle to the axes of the front parts of the wires 34. The dielectric is configured when the first and second components 37 and 47 are united, and the two inner conductors 31 are assembled in a state accommodated in the dielectric 36 to complete the assembling of the terminal unit 30.

In mounting the terminal unit 30 into the first housing 10, a rubber plug 19 is mounted on the outer periphery of the twisted pair cable 35 in advance and the terminal unit 30 then is inserted into the first accommodation chamber 13 from behind the first housing 10 with the front retainer 17 held at the partial locking position. In the process of inserting the terminal unit 30, the inclined surface 46 of the first locking portion 45 resiliently deflects the first locking lance 14.

When the terminal unit 30 is inserted properly, the front stop 53 butts against the first stopper 15 to stop the terminal unit 30 in front and the first locking portion 45 is locked to the first locking lance 14 to retain the terminal unit 30 with respect to the first housing 10. Further, the rubber plug 19 closes an opening on the rear end of the first accommodation chamber 13 in a liquid-tight manner. In the above way, the terminal unit 30 achieves primary locking.

After the terminal unit 30 is inserted properly, the front retainer 17 is pushed from the partial locking position to the full locking position. Thus, the front retainer 17 enters the deflection space 16 and restricts resilient deflection of the first locking lance 14 in a direction separating from the first locking portion 45 to achieve secondary locking of the terminal unit 30. As just described, the terminal unit 30 is retained reliably by primary locking with the first locking lance 14 and secondary locking with the front retainer 17.

In mounting the terminal unit 30 into the second housing 20, the terminal unit 30 is inserted into the second accommodation chamber 21 with the side retainer 25 held at the partial locking position. In the process of inserting the terminal unit 30, the inclined surface 46 of the first locking portion 45 resiliently deflects the second locking lance 22. When the terminal unit 30 is inserted properly, the front stop 53 butts against the second stopper 23 to stop the terminal unit 30 in front, and the first locking portion 45 is locked to the second locking lance 22 to retain the terminal unit 30 with respect to the second housing 20 to achieve primary locking of the terminal unit 30.

After the terminal unit 30 is inserted properly, the side retainer 25 at the partial locking position is pushed to the full locking position to enter the second accommodation chamber 21. In this way, the side retainer 25 is locked to the second locking portion 54 from behind to achieve secondary locking of the terminal unit 30. As just described, the terminal unit 30 is retained reliably by primary locking by the second locking lance 22 and secondary locking by the side retainer 25.

Further, the mating conductors (not shown) are inserted into the insertion openings 41 of the front wall 39 of the first component 37. The first component 37 is made of polybutylene terephthalate, which is a material having a relatively high mechanical strength. Thus, even if the mating conductor interferes with the front wall 39, there is no possibility that the mating conductor is pierced into the front wall 39. Note that the second component 47 also is made of polybutylene terephthalate.

The first connector A of this embodiment is configured by inserting the terminal unit 30 having the inner conductors 31 accommodated in the dielectric 36 into the first accommodation chamber 13 formed in the first housing 10. Further, the second connector B is configured by inserting the terminal unit 30 into the second accommodation chamber 21 formed in the second housing 20. That is, the terminal unit 30 is mounted into a selected one of the first housing 10 and the second housing 20. In other words, the terminal unit 30 can be mounted into either the first or second housing 10 or 20 and is mounted into a selected one of the first housing 10 and the second housing 20 according to need.

The first housing 10 includes the resiliently deflectable first locking lance 14, the front retainer 17 capable of restricting the resilient deflection of the first locking lance 14 and the first accommodation chamber 13. The second housing 20 includes the resiliently deflectable second locking lance 22, the second accommodation chamber 21 and the side retainer 25 facing the second accommodation chamber 21.

The first locking portion 45 and the second locking portion 54 are formed on the outer surface of the dielectric 36. With the terminal unit 30 inserted in the first accommodation chamber 13, the first locking portion 45 is locked to the first locking lance 14 and the front retainer 17 restricts the resilient deflection of the first locking lance 14 so that the terminal unit 30 is retained reliably. Further, with the terminal unit 30 inserted in the second accommodation chamber 21, the terminal unit 30 is retained reliably by the locking of the first locking portion 45 and the second locking lance 22 and the locking of the second locking portion 54 and the side retainer 25.

As just described, the reliability of a function for retaining the terminal unit 30 is excellent regardless of whether the terminal unit 30 is mounted into the first housing 10 or the second housing 20. Further, the terminal unit 30 can be used as a common member for the waterproof first housing 10 and the non-waterproof second housing 20, which are of different types.

Further, the first locking portion 45 and the second locking portion 54 are disposed in regions of the outer surface of the dielectric 36 on opposite sides in the vertical direction intersecting the inserting direction into the first accommodation chamber 13 and the second accommodation chamber 21. According to this configuration, the first locking portion 45 and the second locking portion 54 are disposed in different regions, so that there is a high degree of freedom in designing the shapes and arrangements of the first locking portion 45 and the second locking portion 54.

Further, the front stop 53 is formed in the region (outer surface of the bottom wall 48) of the outer surface of the dielectric 36 where the second locking portion 54 is disposed and is configured to restrict a movement of the terminal unit 30 inserted into the first or second accommodation chamber 13 or 21 beyond a proper insertion position. According to this configuration, the first locking lance 14 and the second locking lance 22 do not resiliently contact the region where the second locking portion 54 is formed, even though the front stop 53 is formed. Thus, insertion resistance is not generated due to the resilient interference of the front stop 53 with the first locking lance 14 or the second locking lance 22.

Further, the second locking portion 54 and the front stop 53 are formed integrally to the single projection 52. Since the second locking portion 54 and the front stop 53 are connected as just described, the strengths of the second locking portion 54 and the front stop 53 are enhanced as compared to the case where the second locking portion 54 and the front stop 53 project separately.

The invention is not limited to the above described and illustrated embodiment. For example, the following embodiments also are included in the scope of the invention.

Although the first and second locking portions are disposed in the regions of the outer surface of the dielectric on sides opposite to each other in the above embodiment, the first and second locking portions may be disposed on the same plane of the outer surface of the dielectric.

Although the second locking portion and the front stop are integrally formed to the single projection in the above embodiment, the second locking portion and the front stop may be in the form of independent projections.

Although only one first locking portion is provided in the above embodiment, two or more first locking portions may be provided.

Although only one second locking portion is provided in the above embodiment, two or more second locking portions may be provided.

Although only one front stop is provided in the above embodiment, two or more front stops may be provided.

Although two inner conductors are accommodated into one dielectric in the above embodiment, one, three or more inner conductors may be accommodated into one dielectric.

Although the dielectric is composed of two components, i.e. the first and second components, in the above embodiment, the dielectric may be composed of a single component.

Although two wires connected to the two inner conductors constitute the twisted pair cable in the above embodiment, the invention can be applied also when a wire connected to an inner conductor does not constitute a twisted pair cable.

Although the first component is made of polybutylene terephthalate (PBT) in the above embodiment, the first component may be made of a material other than polybutylene terephthalate.

Although the second component is made of polybutylene terephthalate (PBT) in the above embodiment, the second component may be made of a material other than polybutylene.

Although both the first component and the second component are made of polybutylene terephthalate (PBT) in the above embodiment, a material combination of the first component and the second component may be polyethylene terephthalate (PET) and polypropylene (PP), polybutylene terephthalate and polyethylene (PE) or polybutylene terephthalate and foamed polybutylene terephthalate.

LIST OF REFERENCE SIGNS

A . . . first connector (connector)
B . . . second connector (connector)
10 . . . first housing
13 . . . first accommodation chamber
14 . . . first locking lance
17 . . . front retainer
20 . . . second housing
21 . . . second accommodation chamber
22 . . . second locking lance
25 . . . side retainer
30 . . . terminal unit
31 . . . inner conductor
36 . . . dielectric
45 . . . first locking portion
52 . . . projection
53 . . . front stop portion
54 . . . second locking portion

The invention claimed is:

1. A connector configured by inserting a terminal unit into a selected one of a first accommodation chamber formed in a first housing and a second accommodation chamber formed in a second housing, the terminal unit accommodating an inner conductor in a dielectric, comprising:

a resiliently deflectable first locking lance formed in the first accommodation chamber;

a front retainer configured to restrict resilient deflection of the first locking lance by being mounted into the first housing;

a resiliently deflectable second locking lance formed in the second accommodation chamber;

a side retainer mounted into the second housing to face inside of the second accommodation chamber;

a first locking portion formed on an outer surface of the dielectric and configured to retain the terminal unit by being locked to the first locking lance when the terminal unit is inserted into the first accommodation chamber and to retain the terminal unit by being locked to the second locking lance when the terminal unit is inserted into the second accommodation chamber; and a second locking portion formed on the outer surface of the dielectric and configured to retain the terminal unit by being locked to the side retainer when the terminal unit is inserted into the second accommodation chamber.

2. The connector of claim 1, wherein the first locking portion and the second locking portion are disposed in regions of the outer surface of the dielectric on opposite sides in a direction intersecting an inserting direction into the first accommodation chamber and the second accommodation chamber.

3. The connector of claim 2, wherein a front stop is formed in the region of the outer surface of the dielectric where the second locking portion is disposed and is configured to restrict a movement of the terminal unit inserted into the first accommodation chamber or the second accommodation chamber beyond a proper insertion position.

4. The connector of claim 3, wherein the second locking portion and the front stop are formed integrally to a single projection.

* * * * *